US007056182B2

(12) United States Patent
Wan

(10) Patent No.: US 7,056,182 B2
(45) Date of Patent: Jun. 6, 2006

(54) BUBBLE PRODUCING TOY WITH FLAT, PLATE-LIKE APERTURE COVERING FILM-PRODUCING MECHANISM

(76) Inventor: Hoi Hung Jimmy Wan, Flat 1-3, 2/F, Sunrey Industrial Building, 610 Cha Kwo Ling Road, Yeu Tong, Kowloon, Honk Kong (HK)

( * ) Notice: Subject to any disclaimer, the term of this patent is extended or adjusted under 35 U.S.C. 154(b) by 0 days.

(21) Appl. No.: 10/967,860

(22) Filed: Oct. 18, 2004

(65) Prior Publication Data

US 2006/0084351 A1 Apr. 20, 2006

(51) Int. Cl.
*A63H 33/28* (2006.01)

(52) U.S. Cl. ..... 446/15; 446/21

(58) Field of Classification Search ..... 446/15–21
See application file for complete search history.

(56) References Cited

U.S. PATENT DOCUMENTS 4,423,565 A 1/1984 Bart
5,042,819 A 8/1991 LaFata
5,462,469 A * 10/1995 Lei ..... 446/15
5,498,191 A 3/1996 DeMars
5,613,890 A * 3/1997 DeMars ..... 446/15
6,416,377 B1 * 7/2002 Bart ..... 446/15
6,547,622 B1 * 4/2003 Thai ..... 446/15
2002/0061697 A1 5/2002 Hornsby
2003/0116224 A1 6/2003 Crawford
2004/0142626 A1 * 7/2004 Choi ..... 446/15

* cited by examiner

*Primary Examiner*—Bena Miller
(74) *Attorney, Agent, or Firm*—Eric Hanscom

(57) ABSTRACT

The invention is directed toward a bubble-producing toy which can be held in a user's hand, and, when activated by the user pulling on a trigger, will produce a stream of bubbles via forced air funneling through an aperture in the invention's "mouth", over which a tongue-shaped flat disk creates a film of bubble solution through which air is forced to create bubbles. Attached to the flat disk is a funnel/catchment basin which recycles bubble solution which did not leave the invention as a bubble.

20 Claims, 6 Drawing Sheets

BUBBLE PRODUCING TOY WITH FLAT, PLATE-LIKE APERTURE COVERING FILM-PRODUCING MECHANISM

CROSS REFERENCE TO RELATED APPLICATIONS

None.

STATEMENT REGARDING FEDERALLY SPONSORED RESEARCH OR DEVELOPMENT

This invention was not federally sponsored.

FIELD OF THE INVENTION

The field of this invention is plastic children's toys. The invention is particularly directed toward a bubble-producing toy which can be held in a user's hand, and, when activated by the user pulling on a trigger, will produce a stream of bubbles via forced air funneling through an aperture in the invention's "mouth", over which a tongue-shaped flat disk creates a film of bubble solution through which air is forced to create bubbles. Below the flat disk is a funnel/catchment basin which recycles bubble solution which did not leave the invention as a bubble.

BACKGROUND OF INVENTION

The art of blowing bubbles for fun and entertainment dates back to, a least, the 1600's, where paintings from that era depict Flemish children blowing bubbles through clay pipes. During the 18th and 19th centuries, mothers in many corners of the globe gave their children leftover washing soap to blow bubbles. In the early 1900's, street vendors in the USA began to sell bubbles as a toy.

During the WW II, a US-based chemical company which manufactured and sold cleaning supplies created what would later become the best selling "toy" item in the world by manufacturing a liquid specifically for making bubbles and placing it in bottles for sale. By the late 1940's bottles of bubble solution revolutionized the toy world and companies began to compete to produce better bubble solutions. During the 1960s, bubbles, along with beads and rainbows, became symbols of peace which further popularized bubbles among adults. From the 1960's until the present day, there has been a continuing trend with many international companies competing to produce not only better bubble solutions, but also better means of allowing children and adults to make bubbles. Today, bubble solution is the #1 selling "toy" in the world, with over 200 million bottles each year.

There have been many bubble-producing toys manufactured over the past half century. The first improvement from the old bubble pipes were ring devices made usually from plastic where the user holds one end and dips the other into a bubble solution to create a film of bubble solution across the ring. The user would then wave the ring through the air, whereby the ring would move through the air faster than the film of bubble solution, resulting in one or more bubbles being "pinched off" as the ring moved through the air. From the basic rings came trigger-activated bubble-producing toys where the user would dig the bubble-emitting end of the device in bubble solution, then aim it into the air and activate some sort of blower by pulling on the trigger.

The next improvement was to experiment with the actual film-producing method. For example U.S. Pat. No. 5,498,191 to DeMars teaches a bubble-producing toy which relies on an applicator bar which moves vertically across the bubble-emitting aperture, thereby leaving a film of bubble solution across the aperture through which air is forced by a fan, also activated by a trigger. U.S. Pat. No. 5,613,890 to DeMars and U.S. Pat. No. 5,462,469 to Lei takes the basic idea from the '191 patent but has the bubble-producing mechanism be a wiper bar which applies a film of bubble solution to the aperture much like an automobile windshield wiper works on a windshield. A similar idea is taught by published U.S. patent application No. 20020061697 which teaches a handheld bubble making device includes a reservoir of bubble making solution that is drawn by a motorized pumping assembly and distributed over a dispensing surface. U.S. patent application No. 20040142626 to Choi describes a bubble-making toy which uses a propeller to cause liquid from an outlet port to spread across the space formed in a ring downstream of the propeller, which assists in spreading liquid across the space defined by the circumferential ring onto which liquid flows from the outlet port.

U.S. Pat. No. 6,416,377 to Bart combines a bubble-blowing device having a rotor which works in conjunction with an electric fan or blower, and a multi-colored lens assembly circumferentially surrounding a light source. U.S. patent application No. 20030116224 to Crawford teaches a vertically-aimed bubble-making machine with a membrane-forming system, a blowing fan, which is intermittently operated. U.S. patent application No. 20040142626 to Choi concerns an invention which makes bubbles via a propeller to cause liquid from an outlet port to spread across the space formed in a ring downstream of the propeller. U.S. Pat. No. 5,042,819 to LaFata teaches a target bubble generation and target shooting system which involves an accordion-like pump actuated by both hands, pushing air through a film-forming elliptical ring structure which is lifted out of the bubble solution and exposed to the stream of air generated by the user pushing in on either side of the invention. U.S. Pat. No. 4,423,565, also to Bart, concerns a bubble-blowing toy gun which blows compressed air through an aperture over which a film forms.

Thus, toy bubble-producing inventions tend to fall into two categories: those in which a ring is dipped or otherwise coated with bubble solution and then exposed to a stream of air, and those in which some sort of wire travels across the aperture, thereby coating the aperture with bubble solution prior to having air blown through the aperture. Both methods effectively generate bubbles, but both have their drawbacks. Without a regular, efficient, user-controlled method of reestablishing the film of bubble solution on the aperture, the "ring" devices tend to lose the film of bubble solution quickly or rely on expensive and/or complicated mechanisms by which the ring is re-inserted into bubble solution or repeatedly covered by bubble solution. While a wire which establishes a film of bubble-producing solution every time it is activated by a user pressing a trigger will effectively prepare the toy for producing bubbles, the wire is prone to breaking or bending, thereby terminating or at least decreasing its efficiency. Furthermore, wires do not lend themselves to projecting any appearance of being part of the toy. For example, there are numerous bubble producing toy animals which have open mouths through which the bubbles exit the machine. A wire or wiper blade across an open hole detracts from the animal-like appearance of a toy. Indeed, the cuteness of a fanciful puppy or kitten bubble blowing device can be severely undercut by the presence of a gun-like structure pointing out of the animal's mouth. Additionally, neither approach causes a film to be caused in the toy's "resting position"; a user has to actively press the trigger to cause a film of bubble solution to be created across the aperture. Finally, neither approach effectively seals the aperture so that a film can be formed immediately, in both cases the forming of a film requires substantial movement of one or more parts of the invention.

As a result, there has been a long-felt need for a toy bubble blowing device which forms a film of bubble solution across the aperture in the toy's resting position, which quickly and effectively forms such a film in a regular and consistent manner, where the act of blowing bubbles can be accomplished by pressing a trigger which both actives the source of air and opens the aperture, leaving a film of bubble solution in place, doing so in a manner which involves a minimal number of moving, delicate parts. There has also been a need for a bubble-producing toy where the film-creating mechanism adds to the appearance of the toy rather than detracting from the manufacturer's attempt to create either a fanciful or realistic appearing animal-based toy.

It was in reaction to these needs that the current invention was created. The invention is particularly directed toward a bubble-producing toy which can be held in a user's hand, and, when activated by the user pulling on a trigger, will produce a stream of bubbles via forced air funneling through an aperture in the invention's "mouth", over which a tongue-shaped flat disk creates a film of bubble solution through which air is forced to create bubbles. Attached to the flat disk is a funnel/catchment basin which recycles bubble solution which did not leave the invention as a bubble.

BRIEF SUMMARY OF INVENTION

It is therefore an object of this invention to provide a toy which produces bubbles from a bubble solution which can be manufactured from relatively few parts and at a relatively low cost.

It an another objective of this invention is to provide a toy which produces bubbles from a bubble solution where the user can vary the size of bubbles produced by the toy by varying the pressure a user applies to the trigger It is also an objective of this invention to provide a means by which a film of bubble solution is applied across the aperture of the toy in the toy's resting position, without requiring the user to depress the trigger to create the film across the aperture.

It is a further object of this invention to provide a ready means by which an empty reservoir of bubble solution can be removed and replaced with a new reservoir.

It is another objective of the invention to provide a flat, plate-like surface which closes off the aperture of the toy and in so doing creates a film of bubble solution across the aperture of the toy while the toy is in its "resting" state.

It is a final objective of the invention to produce a more anatomically-correct toy, whether the toy be made in a fanciful or realistic animal mode, where the flat plate that seals the aperture and forms the film of bubble solution is formed as the tongue of the animal, where when the user pulls on the trigger the tongue sticks out the animal's mouth, the fan turns on, and bubbles begin to be formed and expelled by the toy. Since only a rare user will actually stick his/her face into the path of the bubbles, it is much more important to have the aperture covered with an anatomically-correct covering in the resting position than during the active position.

Other and further objects and features of this invention will be apparent to one skilled in the art. It should be particularly noted that although the animal tongue is used to illustrate the invention, there are a wide number of other shapes, both realistic and fanciful, that are contemplated by the inventor as being manufactured and promoted under the basic concepts contained in this patent.

DETAILED DESCRIPTION OF THE INVENTION

Figure 1:
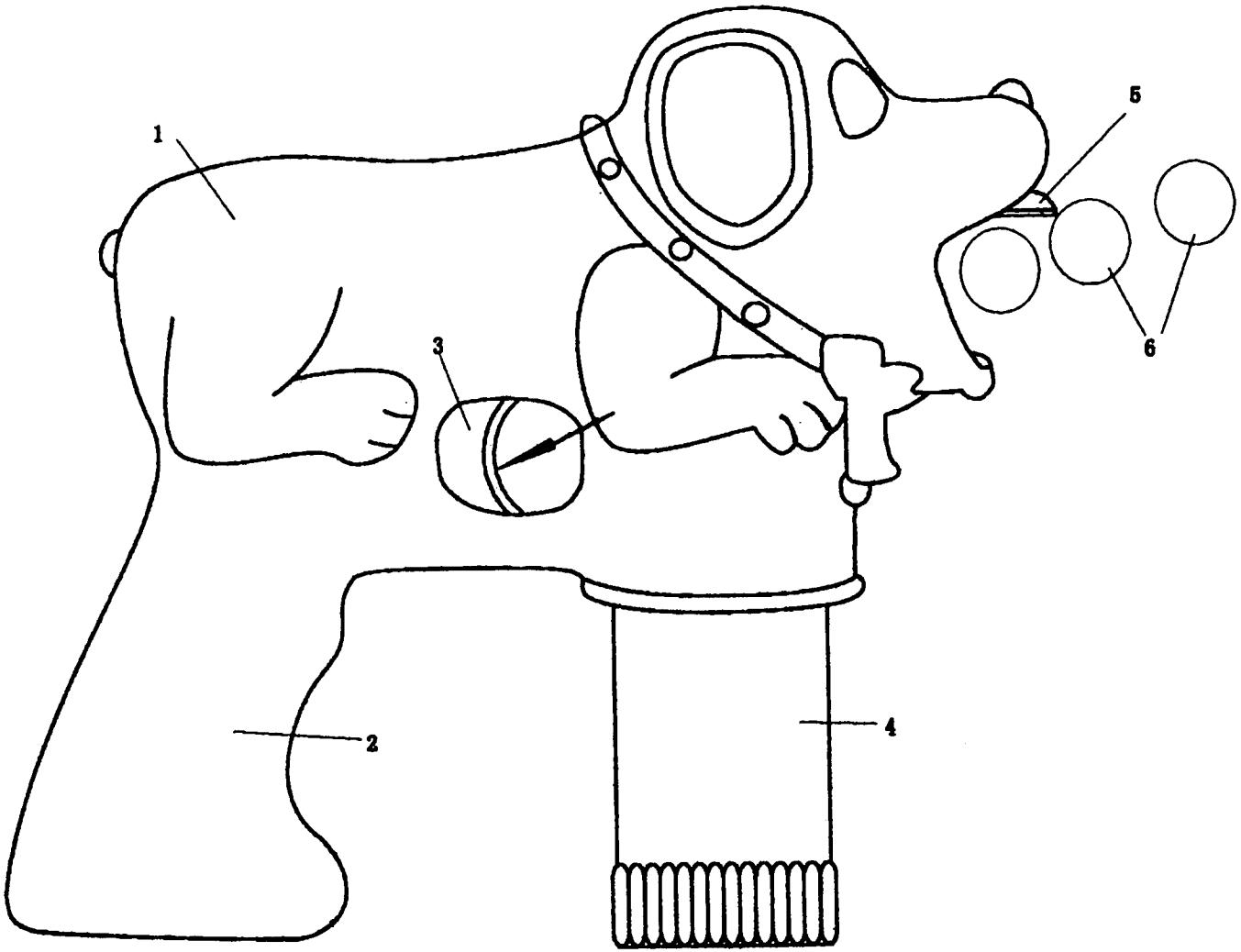
FIG. 1 is a side view of the invention showing the external appearance.

The field of this invention is plastic children's toys. The invention is particularly directed toward a bubble-producing toy which can be held in a user's hand, and, when activated by the user pulling on a trigger, will produce a stream of bubbles via forced air funneling through an aperture in the invention's "mouth", over which a tongue-shaped flat disk creates a film of bubble solution through which air is forced to create bubbles. Attached to the flat disk is a funnel/catchment basin which recycles bubble solution which did not leave the invention as a bubble.

Referring to the drawings, the invention consists of two mating pieces which create the housing of the invention, creating a hollow internal chamber in which the inner workings are located. In brief, using power supplied by batteries or solar energy, when a user presses the trigger, a pump is turned on which pumps bubble solution through tubes from a reservoir to the aperture, where the bubble solution seeps out through small holes surrounding the aperture and, through capillary action seeps under and across a flat, plate-like covering which rests across the aperture, thereby forming a thin film of bubble solution across the aperture. The trigger also activates a fan which creates an air current which flows through an internal air chamber and blows out through the aperture, which is opened by the movement of the flat, plate-like covering, which is also caused by the user pressing the trigger. As the flat, plate-like covering is raised, the film of bubble solution remains across the aperture, and is fed by a constant flow of additional bubble solution from the small holes surrounding the aperture. With the flat, plate-like covering raised, the seal across the aperture is broken, thereby allowing the air current to rush out through the aperture, pinching off bubbles as it flows out, creating a stream of bubbles.

Turning to the figures, FIG. 1 is a side view of the invention, the iteration of which in this case is a puppy, shows an external view. There are two external housings, in this figure the outer left side housing (1) is shown. The housing has a handle (2) which fits into a user's hand, and a trigger (3) by which the user activates the invention. Coming out of the bottom of the invention is a reservoir of bubble solution (4) which can be easily removed and replaced when the toy uses us all the bubble solution. When the trigger (3) is pulled, the pump and air fan (not shown in this figure) are activated, and the flat, plate-like covering (5)

is lifted, thereby opening the aperture and allowing bubbles (6) to be expelled from the aperture.

Figure 2:
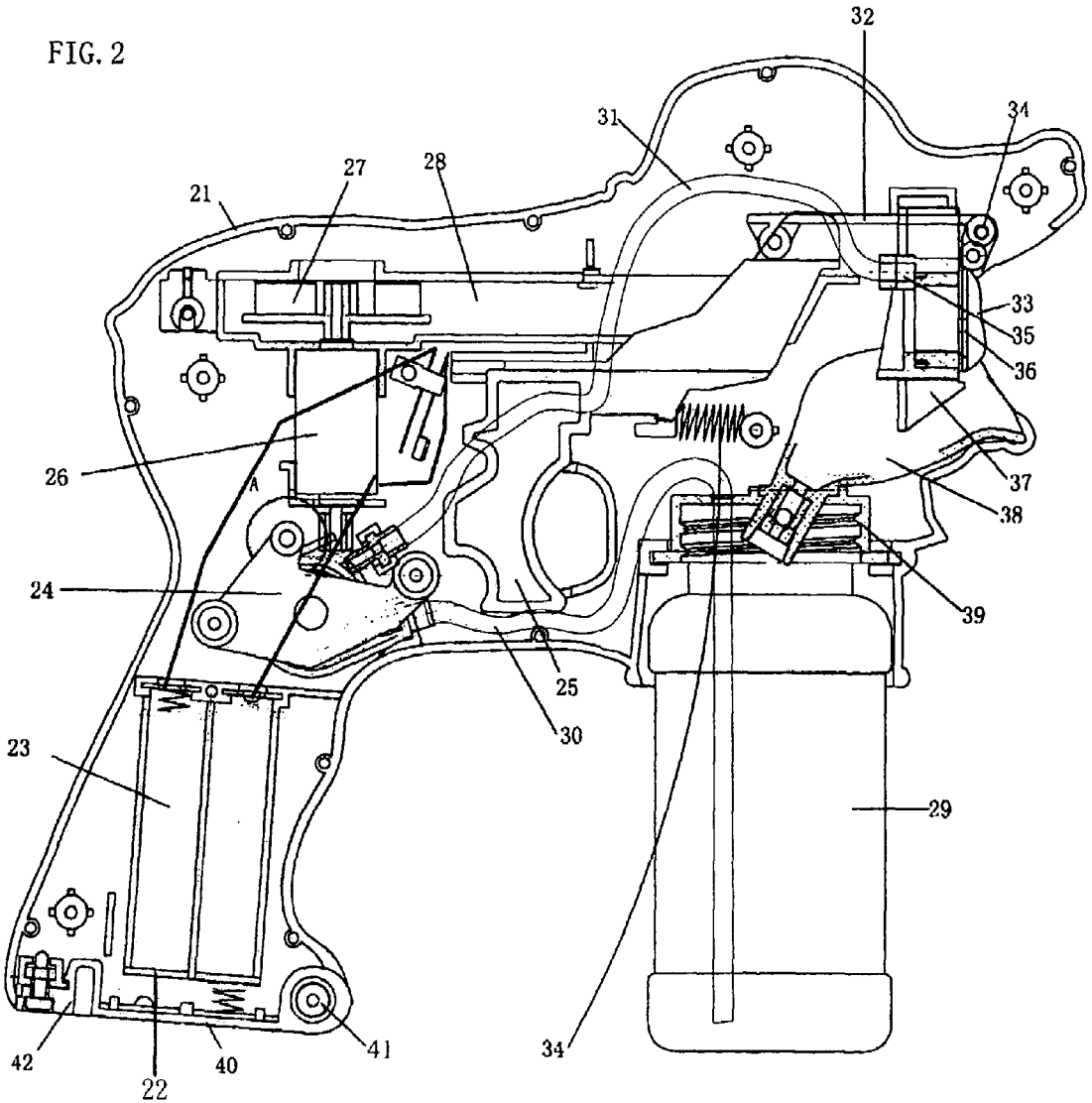
FIG. 2 is a side view of the invention showing the inner workings and basic parts of the invention, with the outer enclosure removed.

FIG. 2 is a side view of the invention showing the inner workings and basic parts of the invention, with the outer enclosure removed. Inside of a right side housing (21) are the internal workings of the invention, shown here in the iteration using batteries rather than solar energy. There is a battery holding compartment (22) which retains the batteries (23) and directs the current to other parts of the invention. The batteries can be accessed through a locking battery compartment hatch (40) which pivots about a battery compartment pivot point (41) and has a clip (42) that a user can press to open or close the battery compartment. The invention has a trigger (25) retained by a trigger spring (34), which, when pulled by a user, activates the batteries (23) and sends electrical current to a pump (24) which pumps bubble solution from a bubble solution reservoir (29) which is attached to the housing through threads (39) through a lower tube (30) through the pump (24) and then through an upper tube (31) to a junction (35) with a hollow ring (36), which contains numerous small holes (not shown in this figure) through which bubble solution drips, coming into contact with a flat, plate-like covering (33), forming, through capillary action a film of bubble solution across the aperture (not shown in this figure). When the trigger (25) is pulled back, a pulling arm (32) also pulls the flat, plate-like covering (33) up as the pulling arm (32) pivots about a covering pivot point (34). The energy from the batteries (23) also turns on a motor (26) which turns a fan (27). The fan (27) generates an air current which travels through an internal air chamber (28) from the fan (27) to the aperture. As bubbles are blown, not all the bubble solution is used up as bubbles and some drips, through gravity, down below the hollow ring (36). A funnel/catchment basin (38) located under the aperture serves to catch any bubble solution not turned into bubbles and funnel the bubble solution back into the reservoir (29) of bubble solution, and a drip flange (37) located under the aperture serves to trap and direct the unused bubble solution into the funnel/catchment basin (38).

Figure 3:
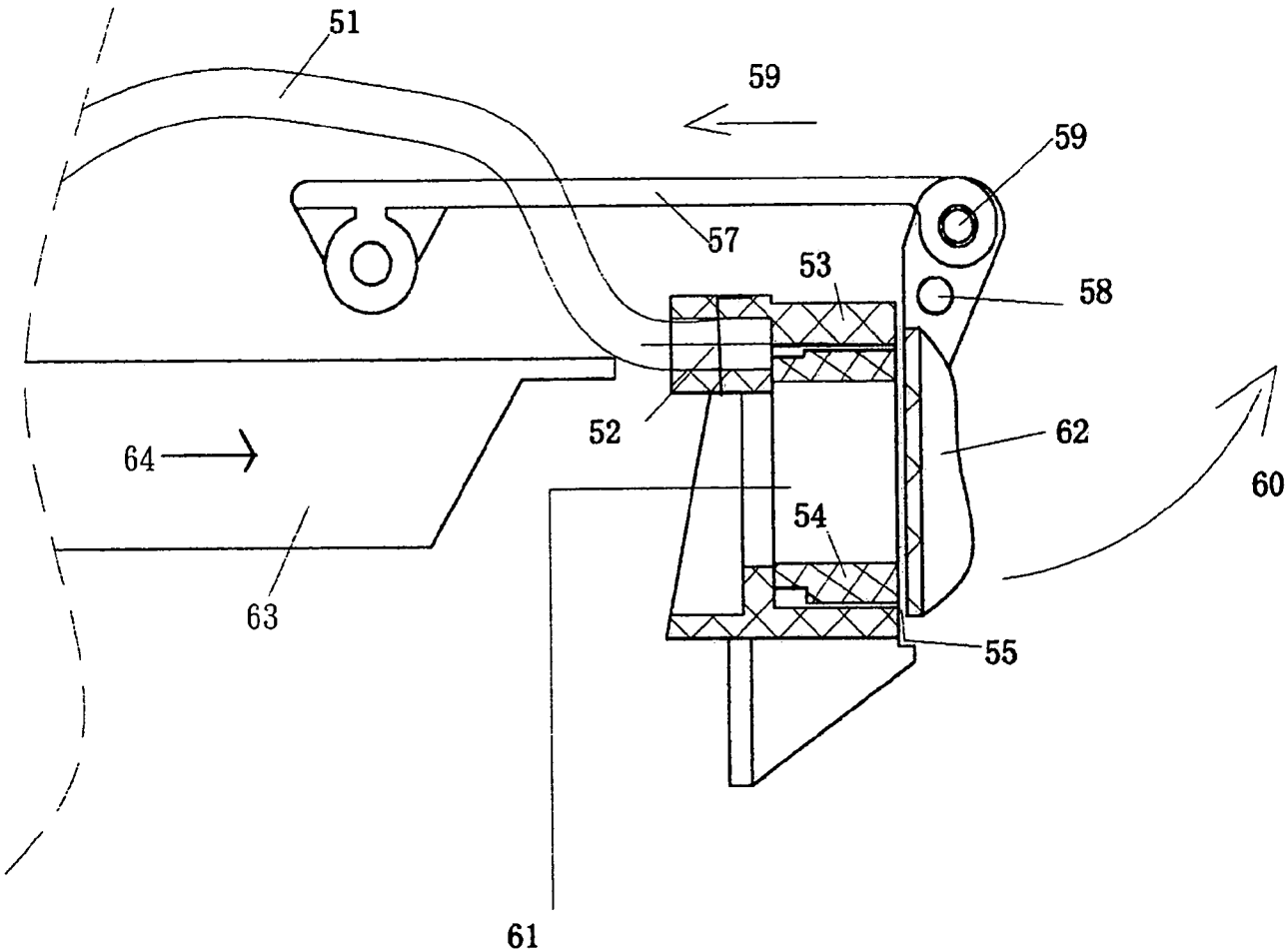
FIG. 3 is a close-up, side view of the film-producing part of the invention in its resting position.

FIG. 3 is a close-up, side view of the film-producing part of the invention in its resting position. The bubble solution comes through an upper tube (51) which terminates in a junction (52) with a hollow ring top portion (53). The hollow ring has a hollow, circular shape with bottom portion (54), and side portions (not shown in this figure) which combine to define the aperture (61). The entire hollow ring has small holes on its side through which the air leaves the invention. The bubble solution drips out of these holes and forms a film, through capillary action, over the aperture (61) along the thin space (55) between a flat, plate-like covering (62) and the hollow ring. Completely covering the aperture (61) is the flat, plate-like covering (62), which can be swung away in a direction identified by (60) when a user pulls the trigger (not shown in this figure), thereby pulling on a pulling arm (57) in a direction indicated by number (59). The flat, plate-like covering (62) is attached to the pulling arm (57) at a rotatable point of attachment (59) which allows the flat, plate-like covering (62) to pivot about a pin (58) which is run through the flat, plate-like covering (62), thereby allowing the flat, plate-like covering (62) to be pulled away from the aperture (61). When the flat, plate-like covering (62) is pulled away from the aperture (61), the same trigger motion that accomplishes this action also causes a fan (not shown in this figure) begins turning and generates an air current (64) which moves through an internal air chamber (63).

Figure 4:
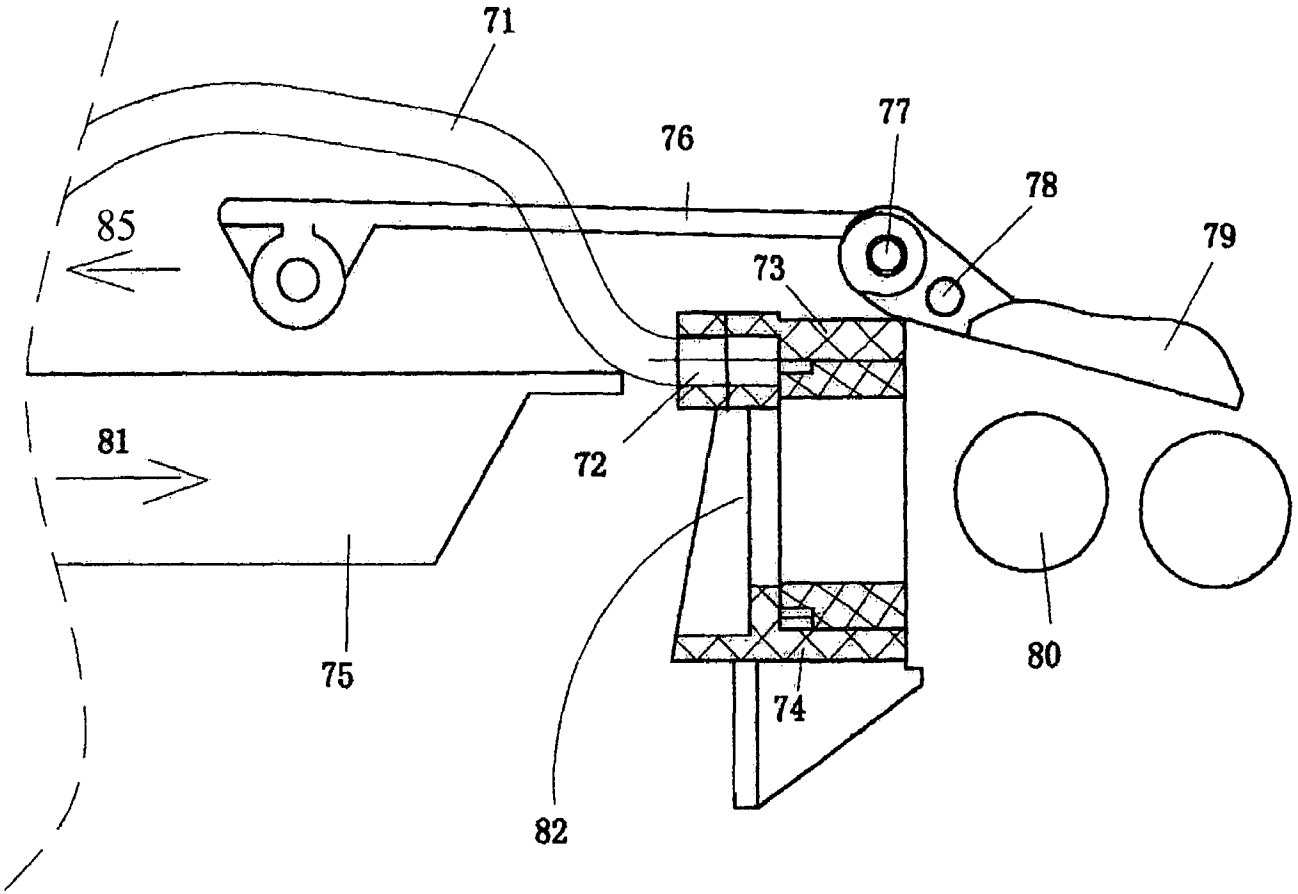
FIG. 4 is a close-up, side view of the film-producing part of the invention in its open position.

FIG. 4 is a close-up, side view of the film-producing part of the invention in its open position. In this figure, the trigger has been pulled and bubbles (80) are being produced. The bubble solution comes through an upper tube (71) which a junction (72) with a hollow ring top portion (73). The hollow ring has a hollow, circular shape with bottom portion (74), and side portions (not shown in this figure) which combine to define the aperture (82). The trigger has pulled a pulling arm (76) in a direction indicated by number (85). The flat, plate-like covering (79) is attached to the pulling arm (76) at a rotatable point of attachment (77) which allows the flat, plate-like covering (79) to pivot about a pin (78) which is run through the flat, plate-like covering (79), thereby allowing the flat, plate-like covering (79) to be pulled away from the aperture (82) when the trigger is depressed by the user. As an air current (81) flowing through an air chamber (75) turns much of the bubble solution across the aperture into bubbles, the film is replenished with additional bubble solution dripping from the small holes (not shown in this figure) on the hollow ring.

Figure 5:
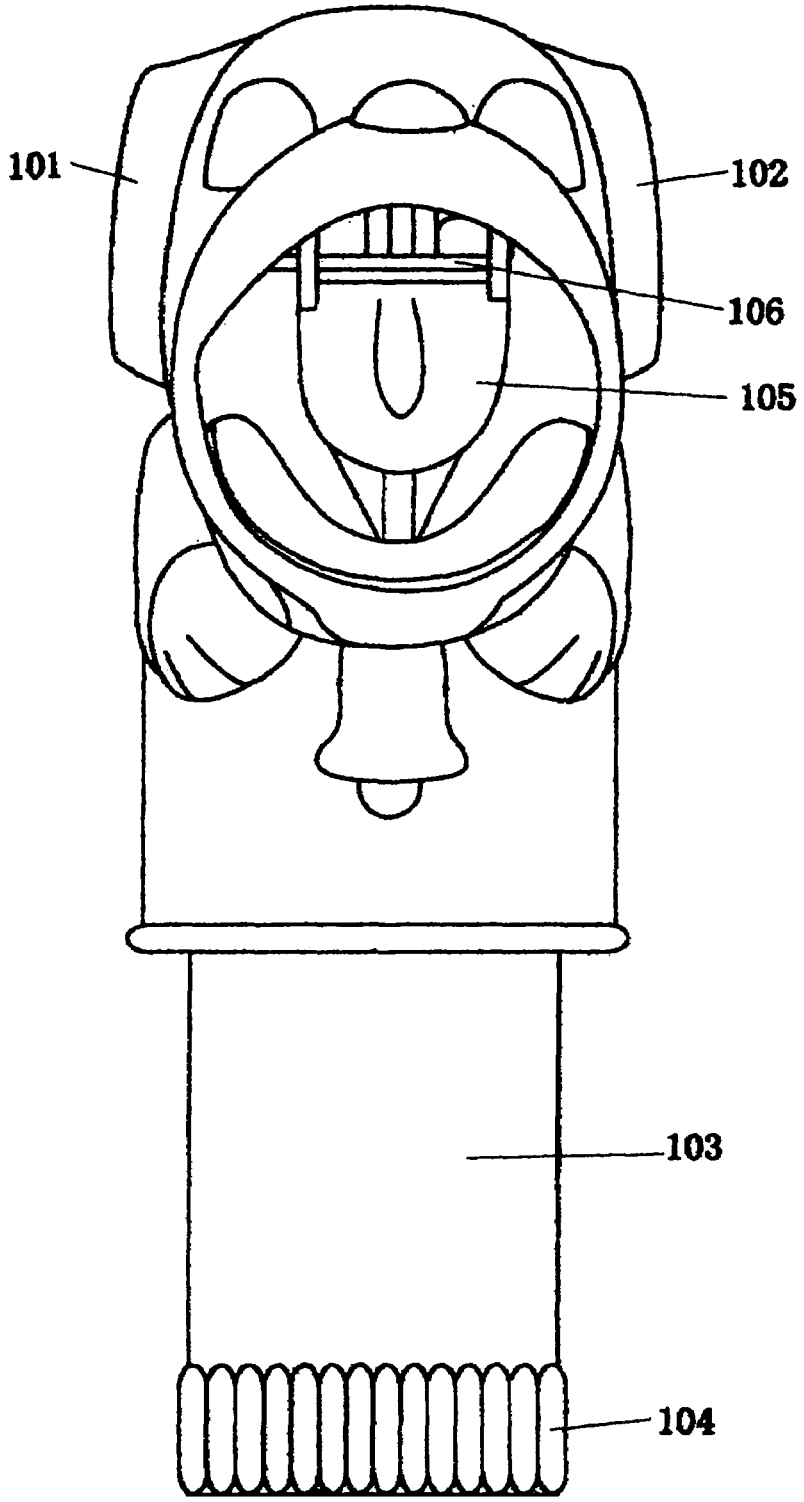
FIG. 5 is a close-up, front end view of the film-producing part of the invention in its resting position.

FIG. 5 is a close-up, front end view of the film-producing part of the invention in its resting position. The invention has a left side housing (101) and a right side housing (102) which define an inner cavity. At the bottom of the housings is a reservoir (103) of bubble solution which, in this figure, has ridges (104) around its bottom to facilitate unscrewing the reservoir. Looking into the mouth of the invention, the aperture is covered by a flat, plate-like covering (105), in this iteration, the tongue of a puppy, which rotates about a pin (106).

Figure 6:
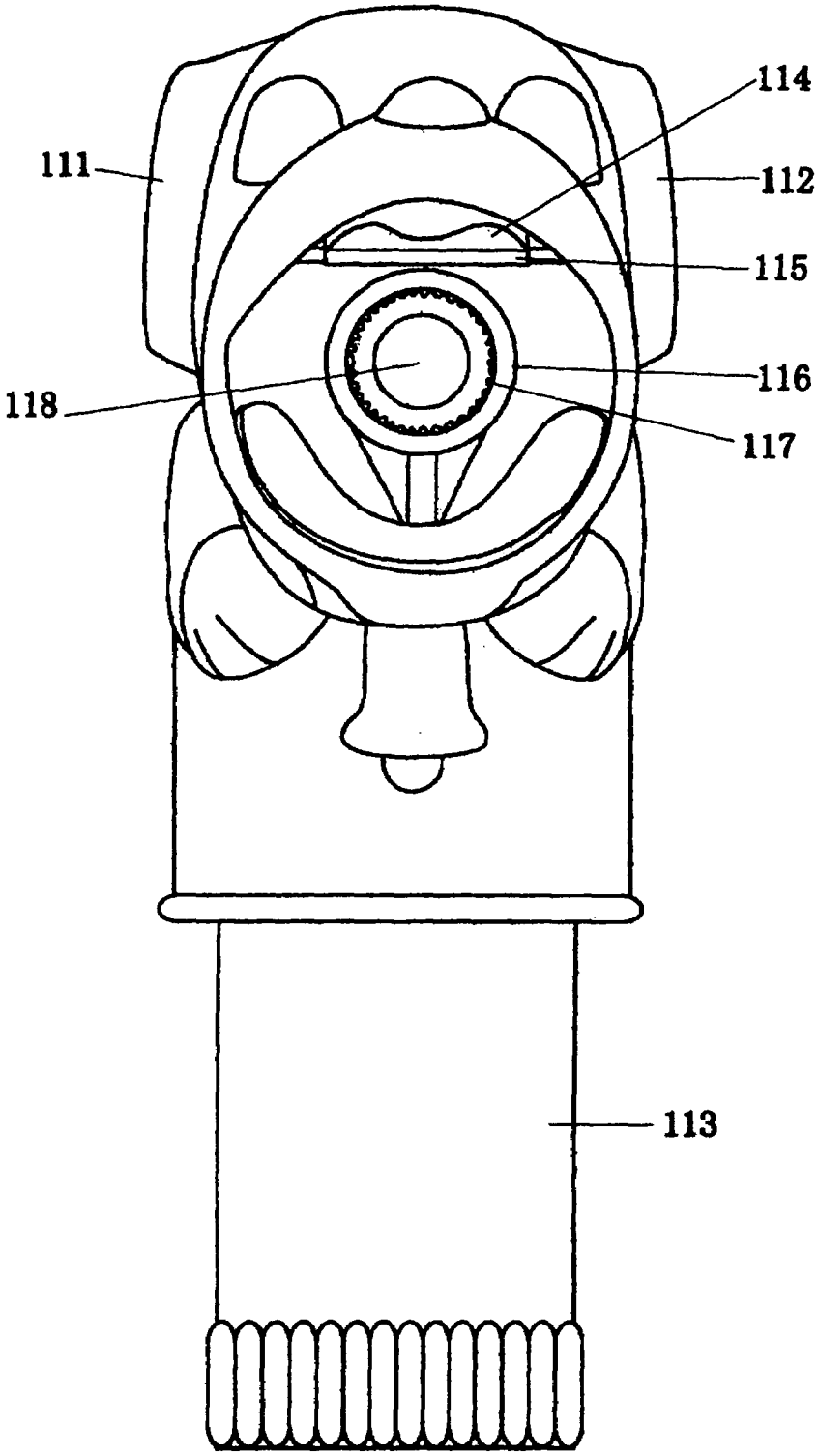
FIG. 6 is a close-up, front end view of the film-producing part of the invention in its open position.

FIG. 6 is a close-up, front end view of the film-producing part of the invention in its open position. The invention has a left side housing (111) and a right side housing (112) which define an inner cavity. At the bottom of the housings is a reservoir (113) of bubble solution. Looking into the mouth of the invention, the aperture (118) is exposed in this figure as a flat, plate-like covering (114), in this iteration, the tongue of a puppy, has been rotated about a pin (115) and pulled up to allow forced air to exit the aperture (118). Defining the aperture (118) is a hollow ring (116) which has a plurality of holes (117) which are small enough so that as bubble solution is pumped through them, the bubble solution drips onto the surface of the hollow ring (116) and forms a film across the aperture (118) when the trigger is allowed to return to its resting position and the flat, plate-like covering (114) is allowed to rotate back down to cover the aperture (118). While the trigger is being pulled, the flat, plate-like covering (114) remains in its "up" position, the aperture (118) remains open, the fan producing the air current remains on, and the pump which pumps bubble solution out the plurality of holes (117) remains on, thereby replenishing the bubble solution that is either turned into bubbles or drips back into the reservoir, thereby maintaining the film of bubble solution across the aperture (118) necessary to make bubbles. Should the film be broken, the user only has to momentarily take his/her finger off the trigger, allowing the flat, plate-like covering (114) to swing back down to its resting position, thereby reestablishing a film of bubble solution across the aperture (118).

What is claimed is:

1. A bubble producing apparatus comprising:

an external housing having a hollow internal chamber, a source of power, a source of bubble solution attached to the external housing, a means of pumping the bubble solution to an aperture, from which a plurality of bubbles are formed and released, a means of generating an air current, a trigger which activates the means of pumping and the generation of the air current, an internal air chamber which conveys the air current to the aperture, a film-creating apparatus comprising an aperture, a hollow ring with a hollow internal section through which the air current is directed by the internal air chamber, a plurality of holes in the hollow ring through which bubble solution is transported from the source of bubble solution to the hollow internal section of the hollow ring, by which bubble solution is expelled onto the surface of the hollow ring to create a film of bubble solution, a flat, plate-like covering which completely covers the hollow ring, thereby allowing through capillary action the creation of a film of bubble solution across the entire aperture, where the flat, plate-like covering can be opened by a user's pulling on the trigger, such that in its resting position the flat, plate-like covering seals the aperture and thereby creates a film of bubble solution across the aperture without the user having to press the trigger, a funnel and catchment basin located under the aperture which serves to catch any bubble solution not turned into bubbles and funnel the bubble solution back into the source of bubble solution, and a drip flange located under the aperture which serves to trap and direct the unused bubble solution into the funnel and catchment basin.

2. The apparatus of claim 1, wherein the source of bubble solution is a reservoir defined by a container with an opening at its top with a series of threads, which screw into an equal number of threads on the internal chamber of the external housing.

3. The apparatus of claim 1, wherein the means of pumping the bubble solution to the aperture is a pump operated by the source of power and connecting the source of bubble solution with the aperture by means of one or more tubes.

4. The apparatus of claim 1, wherein the source of bubble solution is a reservoir defined by sides on its bottom and sides, with an opening at its top with a series of threads, which screw into an equal number of threads on the internal chamber of the external housing and the means of pumping the bubble solution to the aperture is a pump operated by the source of power and connecting the source of bubble solution with the aperture.

5. The apparatus of claim 4, wherein the means of generating an air current is a fan powered by the source of power.

6. The apparatus of claim 5, wherein the source of power is one or more solar batteries.

7. The apparatus of claim 5, wherein the source of power is one or more batteries.

8. A bubble producing apparatus comprising:

an external housing in a fanciful shape of an animal or non-living object, having a hollow internal chamber, a source of power, a source of bubble solution attached to the external housing, a means of pumping the bubble solution to an aperture, from which a plurality of bubbles are formed and released, a means of generating an air current, a trigger which activates the means of pumping and the generation of the air current, an internal air chamber which conveys the air current to the aperture, a film-creating apparatus comprising an aperture, a hollow ring with a hollow internal section through which the air current is directed by the internal air chamber, a plurality of holes in the hollow ring through which bubble solution is transported from the source of bubble solution to the hollow internal section of the hollow ring, by which bubble solution is expelled onto the surface of the hollow ring to create a film of bubble solution, a flat, plate-like covering which completely covers the hollow ring, thereby allowing through capillary action the creation of a film of bubble solution across the entire aperture, where the flat, plate-like covering can be opened by a user's pulling on the trigger, such that in its resting position the flat, plate-like covering seals the aperture and thereby creates a film of bubble solution across the aperture without the user having to press the trigger, where the flat, plate-like covering is in the shape of an animal tongue, a funnel and catchment basin located under the aperture which serves to catch any bubble solution not turned into bubbles and funnel the bubble solution back into the source of bubble solution, and a drip flange located under the aperture which serves to trap and direct the unused bubble solution into the funnel and catchment basin.

9. The apparatus of claim 8, wherein the source of bubble solution is a reservoir defined by a container with an opening at its top with a series of threads, which screw into an equal number of mating threads on the internal chamber of the invention.

10. The apparatus of claim 8, wherein the means of pumping the bubble solution to the aperture is a pump operated by the source of power and connecting the source of bubble solution with the aperture by means of one or more tubes.

11. The apparatus of claim 8, wherein the source of bubble solution is a reservoir defined by sides on its bottom and sides, with an opening at its top with a series of threads, which screw into an equal number of mating threads on the internal chamber of the external housing and the means of pumping the bubble solution to the aperture is a pump operated by the source of power and connecting the source of bubble solution with the aperture.

12. The apparatus of claim 11, wherein the means of generating an air current is a fan powered by the source of power.

13. The apparatus of claim 12, wherein the source of power is one or more solar batteries.

14. The apparatus of claim 12, wherein the source of power is one or more batteries.

15. A bubble producing apparatus comprising:

an external housing in a realistic shape of an animal or non-living object, having a hollow internal chamber, a source of power, a source of bubble solution attached to the external housing, a means of pumping the bubble solution to an aperture, from which a plurality of bubbles are formed and released, a means of generating an air current, a trigger which activates the means of pumping and the generation of the air current, an internal air chamber which conveys the air current to the aperture, a film-creating apparatus comprising an aperture, a hollow ring with a hollow internal section through which the air current is directed by the internal air chamber, a plurality of holes in the hollow ring through which bubble solution is transported from the source of bubble solution to the hollow internal section of the hollow ring, by which bubble solution is expelled onto the surface of the hollow ring to create a film of bubble solution, a flat, plate-like covering which completely covers the hollow ring, thereby allowing through capillary action the creation of a film of bubble solution across the entire aperture, where the flat, plate-like covering can be opened by a user's pulling on the trigger, such that in its resting position the flat, plate-like covering seals the aperture and thereby creates a film of bubble solution across the aperture without the user having to press the trigger, where the flat, plate-like covering is in the shape of an animal tongue, a funnel and catchment basin located under the aperture which serves to catch any bubble solution not turned into bubbles and funnel the bubble solution back into the source of bubble solution, and a drip flange located under the aperture which serves to trap and direct the unused bubble solution into the funnel and catchment basin.

16. The apparatus of claim 15, wherein the source of bubble solution is a reservoir defined by a container with an opening at its top with a series of threads, which screw into an equal number of threads on the internal chamber of the external housing.

17. The apparatus of claim 15, wherein the source of bubble solution is a reservoir defined by sides on its bottom and sides, with an opening at its top with a series of threads, which screw into an equal number of threads on the internal chamber of the external housing and the means of pumping the bubble solution to the aperture is a pump operated by the source of power and connecting the source of bubble solution with the aperture.

18. The apparatus of claim 15, wherein the means of generating an air current is a fan powered by the source of power.

19. The apparatus of claim 15, wherein the source of power is one or more solar batteries.

20. The apparatus of claim 15, wherein the source of power is one or more batteries.

* * * * *